US005490338A

United States Patent [19]

Hwang et al.

[11] Patent Number: 5,490,338

[45] Date of Patent: Feb. 13, 1996

[54] FIXING STRUCTURE FOR LIGHTENING CIRCUIT ON LIGHTENING SHOE

[76] Inventors: Wen I. Hwang, 5F-9, No. 5, Wu Chuan 1 Rd., Hsin Chuang City, Taipei Hsien; Ming C. Tsu, No. 18, Sec. 3, Cherng Der Rd., Taipei, both of Taiwan

[21] Appl. No.: 331,427

[22] Filed: Oct. 31, 1994

[51] Int. Cl.[6] ..... A43B 23/00; F21L 15/08

[52] U.S. Cl. ..... 36/137; 36/136; 362/103; 362/276

[58] Field of Search ..... 36/137, 136, 139; 362/103, 802, 276

[56] References Cited

U.S. PATENT DOCUMENTS

| | | | |
|---|---|---|---|
| 5,357,697 | 10/1994 | Lin | 36/137 |
| 5,396,720 | 3/1995 | Hwang et al. | 36/137 |
| 5,406,724 | 4/1995 | Lin | 36/137 |

FOREIGN PATENT DOCUMENTS

| | | | |
|---|---|---|---|
| 2556190 | 6/1985 | France | 36/137 |
| 2643794 | 9/1990 | France | 36/137 |
| 2675025 | 10/1992 | France | 36/137 |

*Primary Examiner*—Paul T. Sewell
*Assistant Examiner*—Ted Kavanaugh
*Attorney, Agent, or Firm*—Pro-Techtor International

[57] ABSTRACT

A fixing structure for the circuit of a lightening shoe, wherein a receiving recess is provided on the heel for receiving a transparent fixing seat which has on top thereof a box groove for receiving a transparent protecting box further for receiving the circuit, a battey receptacle provided on top of the box allows access to two battery contacting parts on the circuit, two vertical guiding grooves and two horizontal engaging grooves are provided on the wall of the receptacle for engaging two engaging pieces on a receptacle cover to removably enclose the receptacle, hence a battery therein connects the batteru contacting parts to complete the circuit, with this, changing of a battery can be done directly, the lightening circuit can be well protected and can be taken out with the protecting box easily for repairing.

2 Claims, 7 Drawing Sheets

FIXING STRUCTURE FOR LIGHTENING CIRCUIT ON LIGHTENING SHOE

BACKGROUND OF THE INVENTION

1. Field of the Invention

The present invention relates to a fixing structure for lightening circuit on a lightening shoe, and especially to a fixing structure capable of well receiving and protecting a lightening circuit and allowing the lightening circuit to be taken out for examining and repairing as well as allowing batteries to be taken out directly from a groove in the shoe for changing.

2. Description of the Prior Art

Lightening shoes are widely used shoes in fashion having a twinkling effect and are taken by a user in dancing or in exercise, and provide in each of their shoe soles or shoe heels an embeded LED and a lightening electric circuit, the twinkling effect thereof can provide amusement and have a warning effect to increase the safety of a user at night or in a dark ball room. Such shoes are therefore widely welcome in the markets.

The arrangement of the LEDs in a lightening shoe can have multiple types, e.g., the LEDs can be embeded in an instep, or can be embeded in a shoe heel or a sole, the type to which the present invention is related is a structure wherein LEDs are embeded in a shoe heel. A conventional structure for a shoe heel has, as shown in FIG. 1, a groove C in the back side B of a lightening shoe A; while the circuit for lightening is put in a box D which has a size coincident with that of the groove C. The box D is wholly embeded in the groove C with glue, two LEDs in the lightening circuit extend out from the box D but within two transparent covers E. Such structure don't have a good appearance and is subjected to damage by rubbing; therefore, the applicant of the present invention filed an application of a patent (with a Ser. No. 08/163,230 now U.S. Pat. No. 5,396,720) which can eliminate the defects of the conventional structure, please refer to FIG. 2, the structure of this patent comprises a shoe heel G on a lightening shoe body F, in the shoe heel G there is provided a receiving recess H which has two fixing holes H1 on the top surface and a shallow concave groove H2 on the bottom surface thereof, and a transparent fixing seat I is embeded into the heel G, at the top of the fixing seat I there are two lugs I1, while at the bottom of the fixing seat I there is a receiving groove I2 for embedment of a lightening electric circuit J, then the fixing seat I is inserted into the receiving recess H of the shoe heel G with the two lugs I1 extending into the two fixing holes H1 and is fixedly adhered onto the receiving recess H to become a part of the heel G. Further, the structure has a totally smooth and integrate appearance on the rear side of the shoe heel G, no more protuberance, the electronic members are protected in the fixing seat I from collision or damage, so as to increase beauty of the whole shoe, yet light can emit from both sides and the rear side of the fixing seat I, the structure can have better warning and amusement effect.

However, in the above stated patent and the conventional lightening structure, a lightening circuit can not be taken out after it is installed in a shoe heel, in this case, when batteries are damaged or exhausted of power, a user will not be able to examine the circuit or change the batteries, they are therefore not perfect in practicability.

SUMMARY OF THE INVENTION

In view of the above statement, the object of the the present invention is to provide an improved structure against the above mentioned defectes of the lightening structures of prior arts with which a user will not be able to examine the circuit or change the batteries, it is characterized by that, in the structure of the present invention, there is a slot provided on the top of the receiving recess of the shoe heel and extending through to the bottom face of an insole, a protecting box for receiving the lightening electric circuit can be embeded in the fixing seat which can inserted into the receiving recess of the shoe heel, by providing a battery receptacle on the protecting box and an openable and closedable receptable cover, the user can easily lift the insole to take out the protecting box for examination or repairing of the lightening electric circuit or just open the cover by rotating it to take out the battery for changing, so that the lightening electric circuit can be effectively used for a long time.

The features as well as the practical functions of the present invention will be apparent from the detailed description of an embodiment thereof in reference to the accompanying drawings.

DETAILED DESCRIPTION OF THE INVENTION

Figure 1:
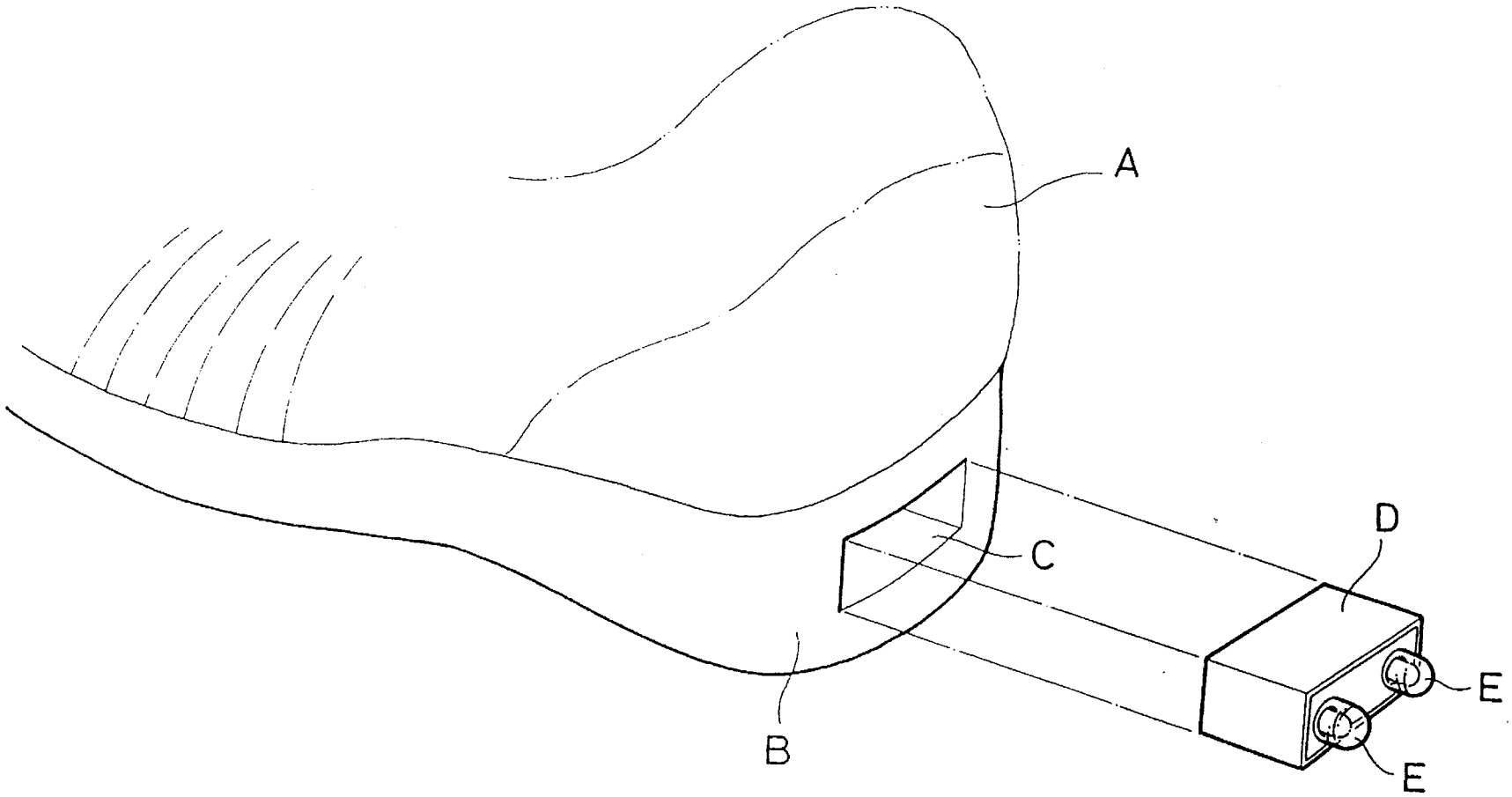
Fig. 1 (PRIOR ART)
FIG. 1 is a perspective schematic view of the lightening device in a shoe heel of a conventional lightening shoe.
Figure 2:
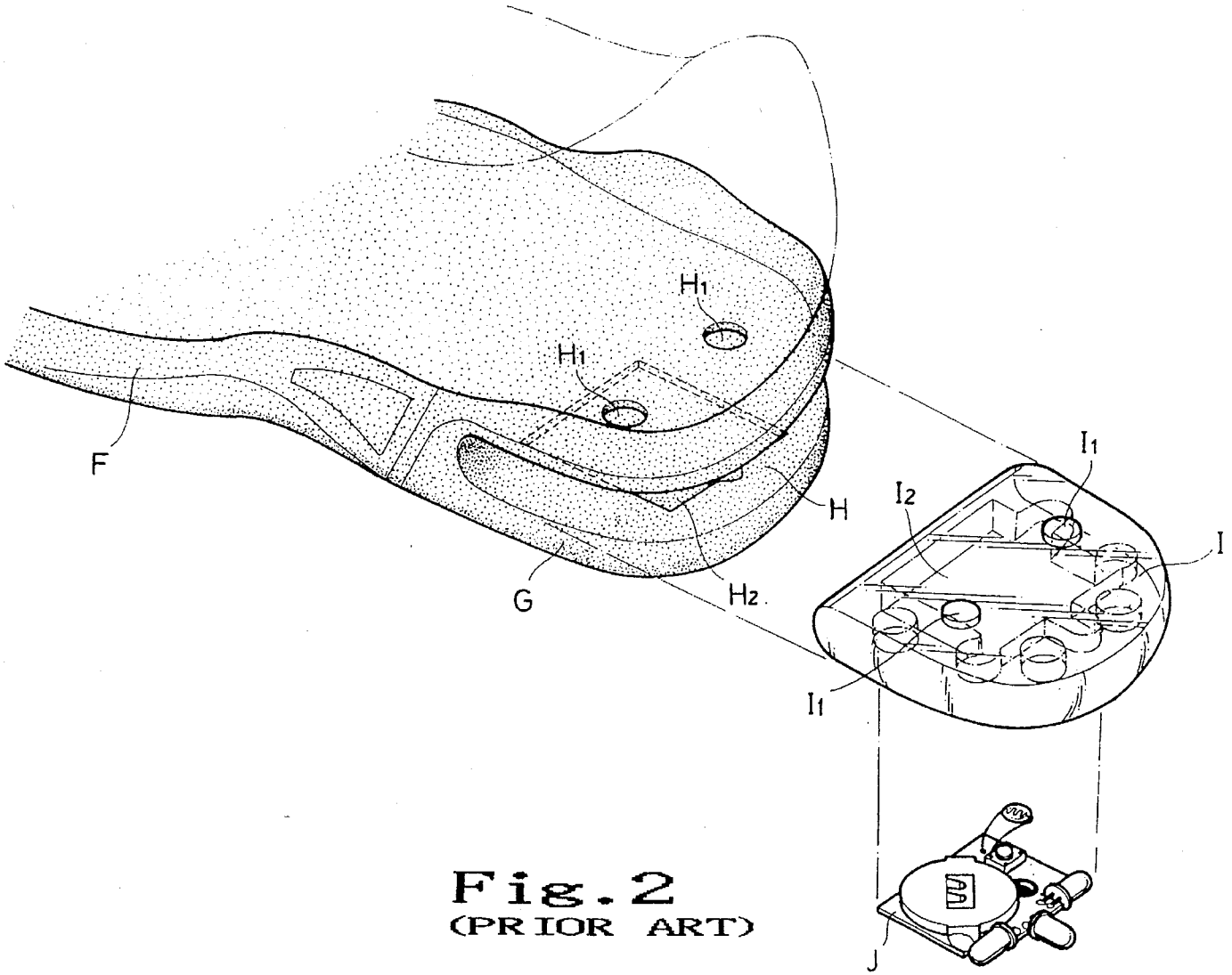
Fig. 2 (PRIOR ART)
FIG. 2 is a perspective schematic view of the lightening device of a prior patent which the inventor of the present invention has filed.
Figure 3:
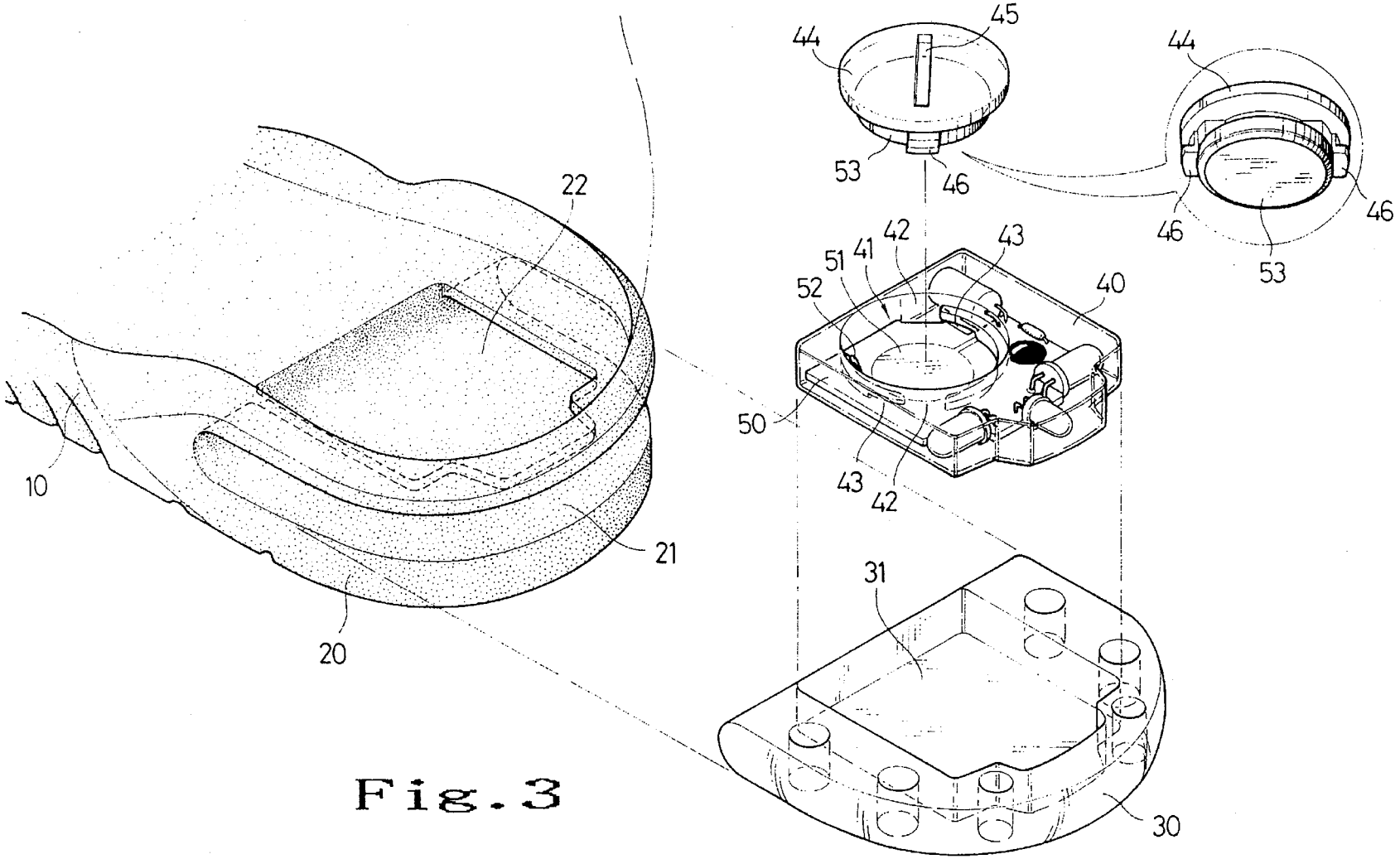
FIG. 3 a perspective as well as anatomic schematic view of the present invention.
Figure 4:
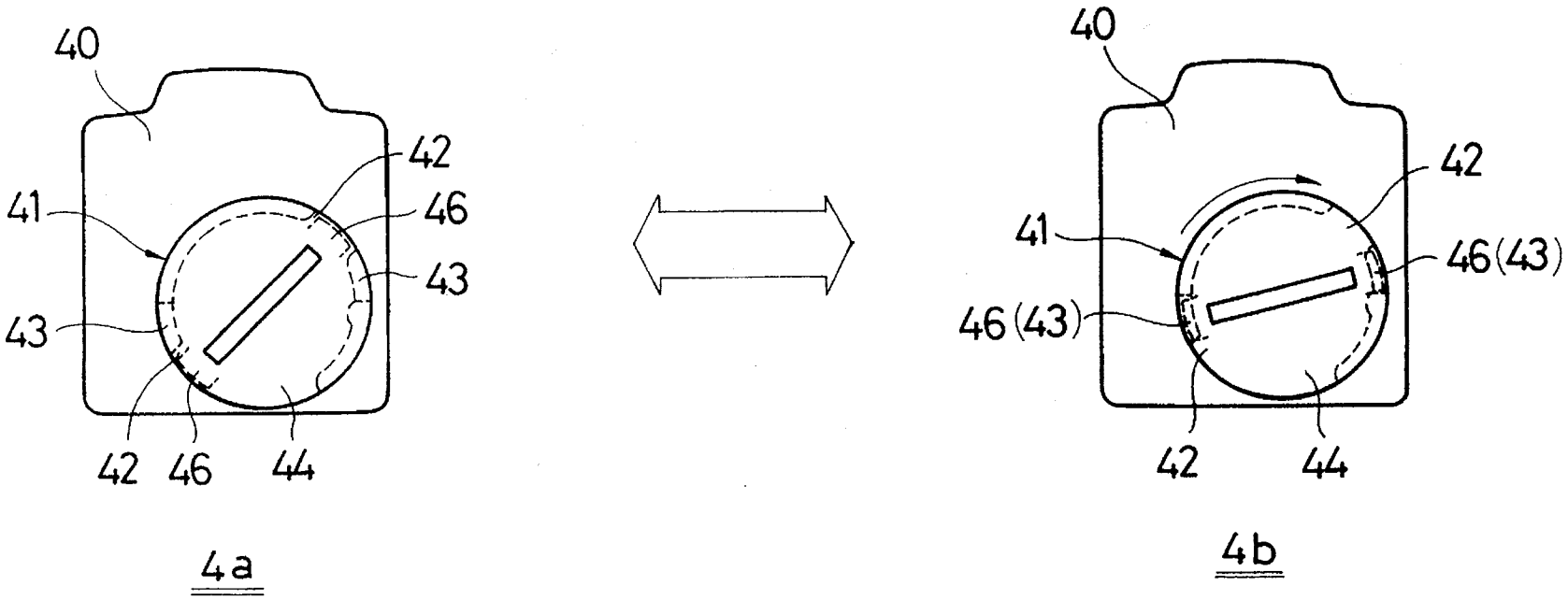
FIG. 4 is a schematic view showing a battery receptacle and a battery cover on a protecting box of the present invention.

Referring to FIG. 3, the structure of the present invention comprises a shoe heel 20 on a lightening shoe 10, in the shoe heel 20 there is provided a receiving recess 21 which extends horizontally and inwardly, on the top of the receiving recess 21 there is provided with a slot 22 extending through to the bottom face of an insole; a soft transparent fixing seat 30 matches in size with the receiving recess 21, a box groove 31 is provided on the top of the fixing seat 30 which can be embeded in the receiving recess 21 to connect integrately with the shoe heel 20 and to render the box groove 31 to aligne with the slot 22; a transparent protecting box 40 matches in size with the box groove 31, the interior of the protecting box 40 receives a lightening electric circuit 50, the protecting box 40 can be embeded in the box groove 31 in a slightly tight mode because of the size thereof matching with that of the box groove 31 of the fixing seat 30 plus the soft material of which the fixing seat 30 is made, but it can be taken out of the box groove 31 with a force exerted by a user, a battery receptacle 41 is provided on the top of the protecting box 40 for connection of the lightening electric circuit 50 having two battery contacting parts 51, 52, on the wall of the battery receptacle 41 there are two opposite vertical guiding grooves 42 which each neighbours with a horizontal engaging groove 43 located clockwise aside one guiding groove 42, a cover 44 is provided on the battery receptacle 41, a groove 45 with "-" shape is provided on the top of the receptacle cover 44, while on the bottom of the receptacle cover 44 there are two "L" shaped engaging pieces 46 corresponding in position to the two vertical guiding grooves 42 respectively, so that a battery 53 can be engaged between the two engaging pieces 46 so as to be integrately connected with the receptacle cover 44; further referring to FIG. 4, the receptacle cover 44 can cover the battery receptacle 41 with its two engaging pieces 46 aligned with the two guiding grooves 42 on the battery receptacle 41 (as shown in FIG. 4*a*), when the battery 53 contacts the two battery contacting parts 51, 52 during covering, the top surface of the receptacle cover 44 will be on the same plane as that of the top surface of the protecting box 40, while the two engaging pieces 46 and the horizontal engaging grooves 43 of the battery receptacle 41 are on the same level, at this time, the wall portions located counterclockwise aside the two vertical guiding grooves 42 are in the way, the receptacle cover 44 can not be rotated counterclockwise, and because the horizontal engaging grooves 43 locate clockwise aside the guiding grooves 42, therefore, the receptacle cover 44 can be rotated clockwise to render the two engaging pieces 46 to engage with the horizontal engaging grooves 43 and abutt against the wall of the horizontal engaging grooves 43 (as shown in FIG. 4*b*), in this way, due to engaging of the two engaging pieces 46 in the horizontal engaging grooves 43, the receptacle cover 44 can thus be fixedly located (with the battery 53 inclusive) without worry of dropping, and the lightening electric circuit 50 can provide stable and adequate power due to firm contact between the battery 53 and the two battery contacting parts 51, 52.

Figure 6:
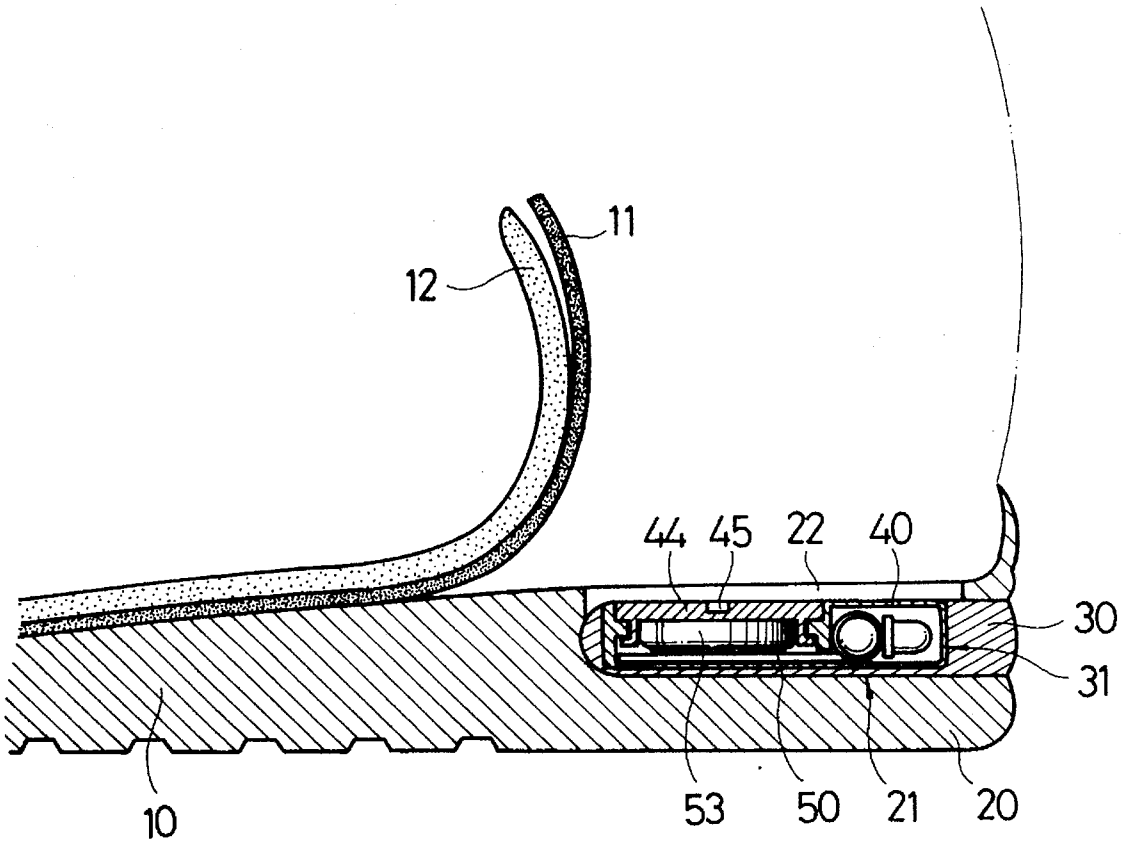
FIG. 6 is a lateral sectional view, showing the invention after assembling thereof.

With the above stated structure, the assembly of the present invention and the lightening shoe 10 is like what shown in FIG. 6, wherein the lightening electric circuit 50 is received in the protecting box 40 which in turn is received in the box groove 31 of the fixing seat 30 which further in turn is inserted and adhered in the receiving recess 21 of the lightening shoe 10 to be integrate with the shoe heel 20; at this time, the protecting box 40 of the present invention is located exactly under the slot 22, while there are provided a hard insole 11 and a soft insole 12 in the shoe 10, hence when a user wears on the shoe 10, his feet will not damage the present invention due to separation of the hard insole 11 and the soft insole 12; when it is to examine or repair the lightening electric circuit 50, the hard insole 11 and the soft insole 12 can be lifted (the rear portions thereof are not adhered) to reveal the slot 22, the protecting box 40 can thus be taken out of the box groove 31 of the fixing seat 30 as a whole to allow an examining and repairing work; when the power of the battery is exhaused, the hard insole 11 and the soft insole 12 can be likewise lifted (it is not necessary to take out the protecting box 40), a coin or a suitable screw driver etc. can be inserted in the groove 45 of the receptacle cover 44, then rotate the receptacle cover 44 counterclockwise till the two engaging pieces 46 abutt against the wall portions of the guiding grooves 42 (at this time, the receptacle cover 44 can not further rotate), and the receptacle cover 44 (together with the battery 53 at the bottom thereof) can be taken out vertically, then the used battery 53 can be taken off from the area between the two engaging pieces 46, a new battery 53 is reloaded, pursuant to the above stated procedure (as shown in FIG. 4), the receptacle cover 44 is inserted again at the slot 22 into the battery receptacle 41 of the protecting box 40, and is rotated clockwise till it is not able of rotating further, at this time, the receptacle cover 44 is fixedly engaged, the changing of battery is thus comleted, the operation is simple and easy, while the lightening electric circuit 50 can be effectively used for a long time.

Figure 5:
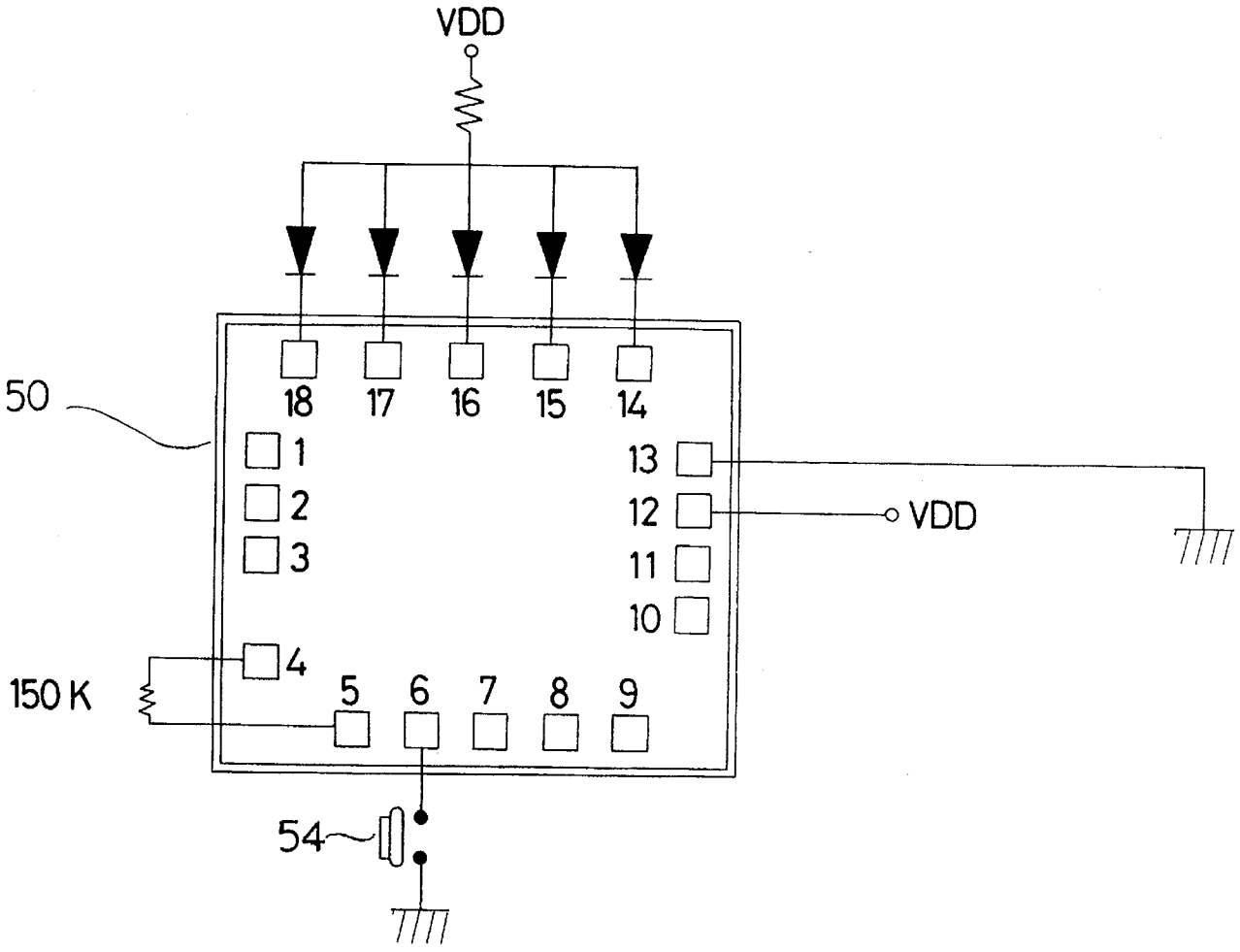
FIG. 5 is a schematic view showing the position of a vibrating switching on the lightening electric circuit of the present invention.
Figure 7:
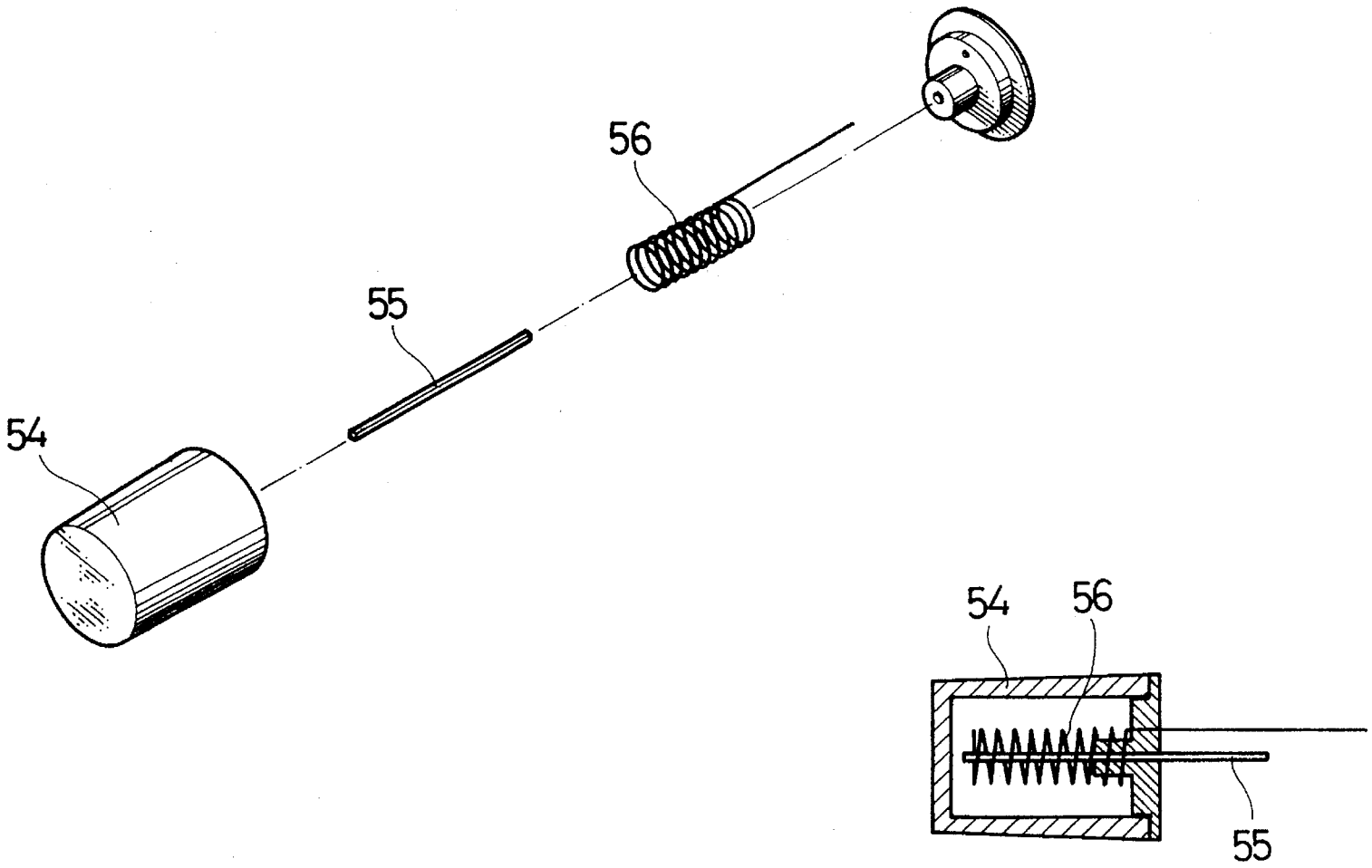
FIG. 7 is a diagram showing an analytic and an assemled sectional views of a vibrating switch in the lightening electric circuit of the present invention.

A novel vibrating switch 54 is used on the lightening electric circuit 50, referring to FIG. 5 and 7, it has therein a straight electrically conductive rod 55 which is fixed and is encircled by an electrically conductive spring 56, when the lightening shoe 10 is in static state, the electrically conductive spring 56 is not in contact with the electrically conductive rod 55, the lightening electric circuit 50 will be in off state, while when the lightening shoe 10 is in motion, the electrically conductive spring 56 will wave up and down to contact intermitently with the electrically conductive rod 55, so that the lightening electric circuit 50 will be turned on and off intermitently, and all the LEDs will twinkle until the lightening shoe 10 stops motion, then the electrically conductive spring 56 will again not be contacted with the electrically conductive rod 55 by the elasticity of its own, the LEDs thus will be turned off, this is a delicate arrangement.

Accordingly, through the above stated structure, the defect of difficuty in examining or repairing the lightening electric circuit and changing a battery on a conventional lightening shoe 10 can be effectively improved, wherein the protecting box 40 provides firm reception and protection for the lightening electric circuit 50; besides, the slot 22 in the receiving recess 21 and the battery receptacle 41 in the protecting box 40 as well as the receptacle cover 44 altogether make the examination and repairing of the lightening electric circuit 50 and changing of the battery 53 easy and convenient, the lightening electric circuit 50 can thus be effectively used for a long time.

Having thus described my invention, what we claim as new and desire to be secured by Letters Patent of the United States is:

1. A fixing structure for the lightening circuit on a lightening shoe, comprising on a shoe heel of said lightening shoe a receiving recess;

a soft transparent fixing seat capable of inserting in and matching with said receiving recess by size;

a box groove on the top of said fixing seat being aligned with a slot provided on the top of said receiving recess and extending through to the bottom face of an insole in said lightening shoe;

a transparent protecting box received by and matching by size with said box groove of said fixing seat;

a lightening electric circuit being received in said transparent protecting box;

a battery receptacle being provided on the top of said protecting box and being allowable of access to two battery contacting parts on a circuit board for said lightening electric circuit;

two vertical guiding grooves being provided on the wall of said battery receptacle;

two horizontal engaging grooves each being located clockwise aside one of said guiding grooves;

a receptacle cover having a groove thereon being able of covering said battery receptacle;

two "L" shaped engaging pieces corresponding by position to said two guiding grooves and being provided on the bottom of said receptacle cover;

a battery being inserted between and engaged by said engaging pieces, said engaging pieces being able of inserting in said vertical guiding grooves, and rotation of said receptacle cover rendering said engaging pieces to engage said horizontal engaging grooves and thereby covering said battery receptacle of said protecting box.

2. A vibrating switch used on the lightening electric circuit as stated in claim 1, said vibrating switch comprises therein a straight electrically conductive rod which is fixed and is encircled by an electrically conductive spring, wherein:

when said lightening shoe is in static state, said electrically conductive spring is not in contact with said electrically conductive rod, said lightening electric circuit will be in off state; while when said lightening shoe is in motion, said electrically conductive spring will wave up and down to contact intermitently with said electrically conductive rod, so that said lightening electric circuit will be turned on and off intermitently, and all the LEDs used in said lightening electric circuit will twinkle until said lightening shoe stops motion, then said electrically conductive spring will again not be contacted with said electrically conductive rod by the elasticity of its own, said LEDs thus will be turned off.

* * * * *